US005148942A

United States Patent [19]

Snook

[11] Patent Number: 5,148,942

[45] Date of Patent: Sep. 22, 1992

[54] FILING BOX WITH ADJUSTABLE AND SELECTIBLE POSITION DIVIDERS, HAVING CORRUGATED BOX AND DIVIDER WALLS

[76] Inventor: Steven E. Snook, 921 High Country Dr., Glendora, Calif. 91740

[21] Appl. No.: 796,349

[22] Filed: Nov. 22, 1991

[51] Int. Cl.[5] ..... B65D 25/06

[52] U.S. Cl. ..... 220/533; 206/561; 206/425

[58] Field of Search ..... 206/425, 455, 456, 561; 220/533, 532, 529

[56] References Cited

U.S. PATENT DOCUMENTS

| | | | |
|---|---|---|---|
| 1,221,631 | 4/1917 | Trout | 220/532 |
| 4,308,953 | 1/1982 | Cohen | 220/533 |
| 4,389,133 | 6/1983 | Oberst | 220/532 |
| 4,828,133 | 5/1989 | Hougendobler | 220/533 |

FOREIGN PATENT DOCUMENTS

| | | | |
|---|---|---|---|
| 444059 | 5/1927 | Fed. Rep. of Germany | 220/533 |
| 156136 | 10/1932 | Switzerland | 220/533 |
| 222340 | 10/1924 | United Kingdom | 220/533 |
| 614981 | 12/1948 | United Kingdom | 220/533 |
| 993457 | 5/1965 | United Kingdom | 220/533 |

OTHER PUBLICATIONS

Photo of Conventional baseball card box, (No date available).

*Primary Examiner*—William I. Price
*Attorney, Agent, or Firm*—William W. Haefliger

[57] ABSTRACT

A reinforced box, with adjustable dividers, the box having a bottom wall, and laterally extending upright, opposite end walls, the box also having longitudinally extending, upright side walls and partition walls extending between and connected to the opposite end walls; there being angled slots cut into the side walls and partition walls to intersect the tops thereof, the slot extending at acute angles relative to a top plane defined by the tops of the side walls and partition walls; and panel-shaped dividers carried by and extending between certain of the longitudinally extending walls, each divider having wings respectively received in two of the angled slots, and the dividers having lower portions extending below the levels of the wings and slots, and between the longitudinal walls; whereby the dividers and longitudinal walls between which they extend form cells to receive cards in ordered face-to-face relation.

15 Claims, 3 Drawing Sheets

FILING BOX WITH ADJUSTABLE AND SELECTIBLE POSITION DIVIDERS, HAVING CORRUGATED BOX AND DIVIDER WALLS

BACKGROUND OF THE INVENTION

This invention relates generally to portable card filing and carrier boxes, and more particularly to a low cost, easily used box wherein cards may be segregated in cells of adjustable size, and supported to extend generally upright for easy inspection.

There is need for portable boxes of very low cost, of the type referred to above. In particular, there is need for such boxes wherein card reception or filing cells may be easily size adjusted, the box walls and cells to consist of cardboard laminate so as to be stiffened for maintaining the shape of the cells.

SUMMARY OF THE INVENTION

It is a major object of the invention to provide an improved box of the above type, having the essential, desirable characteristics, and being of extremely low cost construction. Basically, the box is characterized by:

a) a bottom wall, and laterally extending upright, opposite end walls, the box also having longitudinally extending, upright side walls and partition walls extending between and connected to said opposite end walls, b) there being angled slots cut into the side walls and partition walls to intersect the tops thereof, the slots extending at acute angles relative to a top plane defined by the tops of the side walls and partition walls, c) and panel-shaped dividers carried by and extending between certain of the longitudinally extending walls, each divider having wings respectively received in two of the angled slots, and the dividers having lower portions extending below the levels of the wings and slots, and between the longitudinal walls, d) whereby the dividers and longitudinal walls between which they extend form cells to receive cards in ordered face-to-face relation.

As will appear, the box walls advantageously consist of low cost cardboard laminate that includes a corrugated layer between and adherent to two outer parallel sheets; and the dividers may consist of the same laminate and be of the same thickness as the wall laminates.

Typically, the slots extend from the tops of the longitudinally extending walls toward the bottoms of the walls, the slots having length substantially less than the vertical height dimensions of the longitudinally extending walls, the divider lower portions having opposite edges below the slots that engage the sides of the longitudinally extending walls to resist lateral deflection of the walls.

A further object is to provide a construction wherein the wings of two separate dividers ar received in the same partition wall slot and enter the slot from opposite sides thereof, whereby each wing is received in only a portion of the slot. In this regard, isolation of the dividers is provided to enhance their separate adjustability into different slots, by providing the walls into which the wings extend to consist of doubled thickness laminate, each acting to engage and position one wing. Typically, the partition wall into which the wings of the two separate dividers extend has two cardboard laminate thickness, each laminate including a corrugated layer between and adherent to two outer parallel sheets, whereby each wing extends substantially completely through that portion of the slot defined by one laminate and each wing is carried by one laminate. Such two laminates are typically defined by a single laminate layer folded downwardly at the top plane to bring the two laminates into adjacent, vertical, side-by-side relation, the slots cut through both the laminates. The partition walls and box side walls thereby being smooth and flat.

Another object is to provide for divider adjustability as between two partitions by providing the wings with lowermost edges that are angled to extend downwardly and sidewardly from within the slots to the exterior of the slots.

Yet another object, as respects box stability and strength, is to provide box end walls with multiple face-to-face laminate thickness, that end wall laminate having a section closest to a divider, with the section a) folded downwardly from the top plane and between the longitudinal walls that carry the divider, and b) having a lowermost tab which is received in a retention slot formed by the box bottom wall.

These and other objects and advantages of the invention, as well as the details of an illustrative embodiment, will be more fully understood from the following specification and drawings, in which:

DRAWING DESCRIPTION

Figure 1:
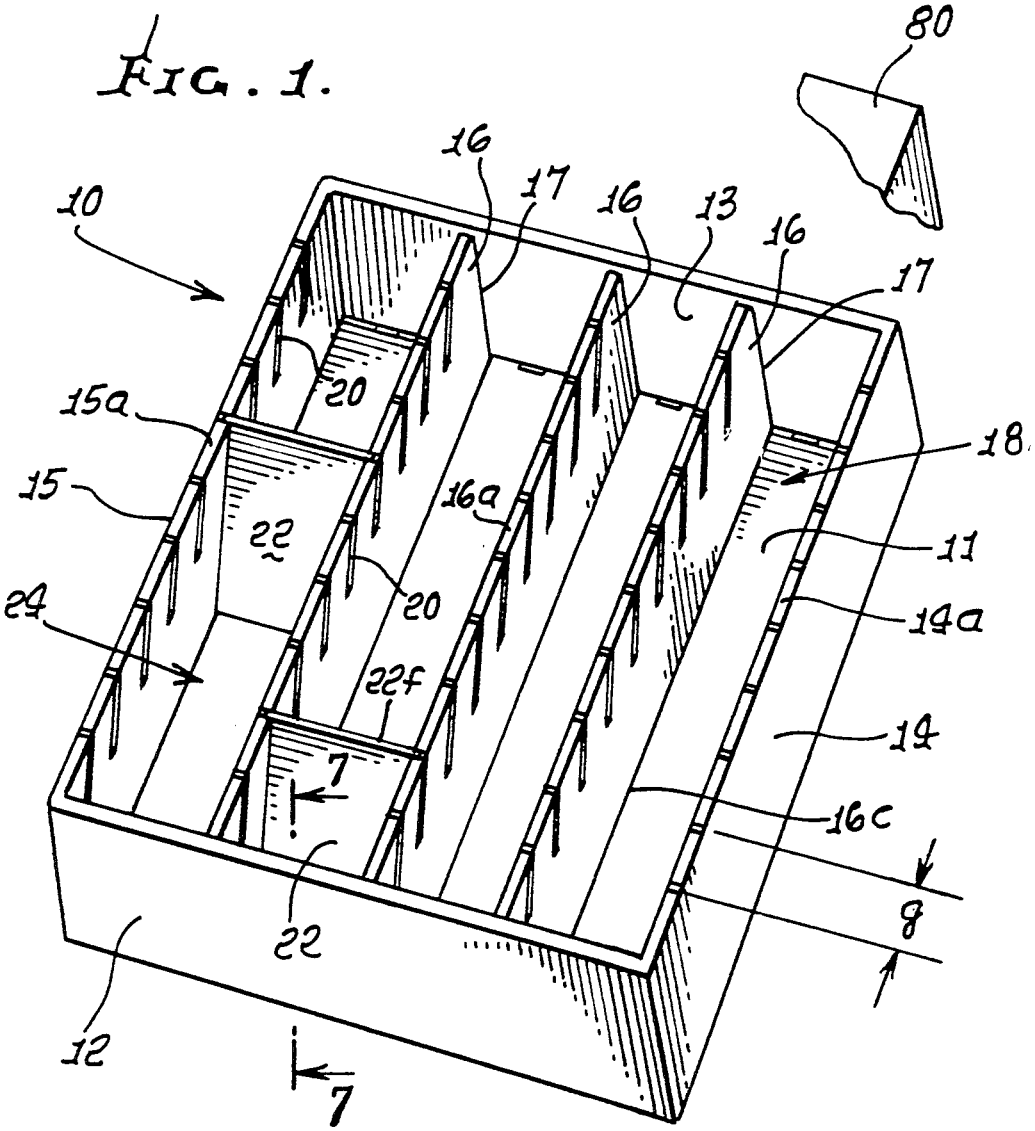
FIG. 1 is a perspective view of a box incorporating the invention.
Figure 5:
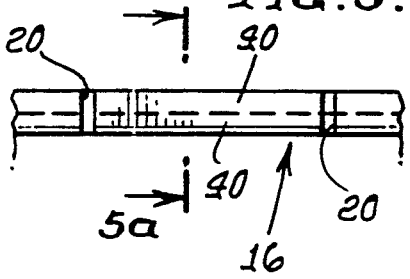
Figure 5A:
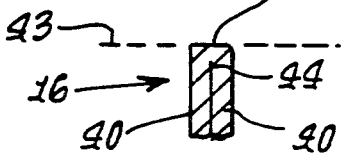
Figure 4:
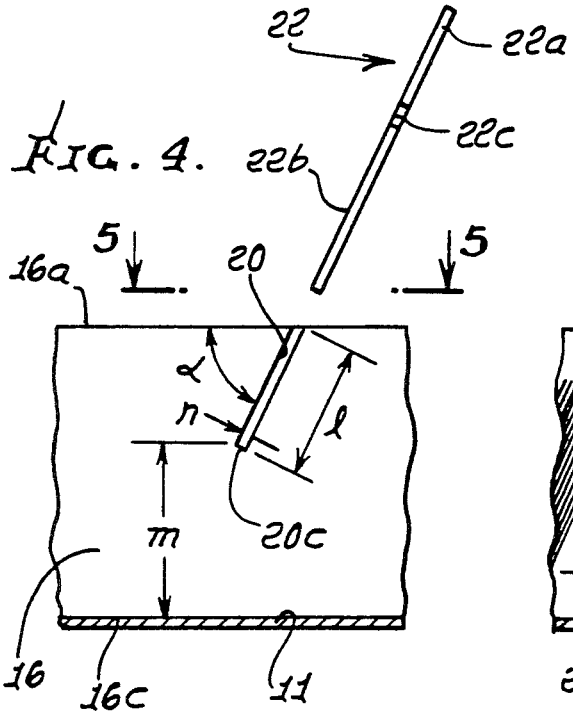
FIG. 4 is an enlarged side view of a box partition having a slot cut therein, and showing a divider poised to enter the slot.
Figure 4A:
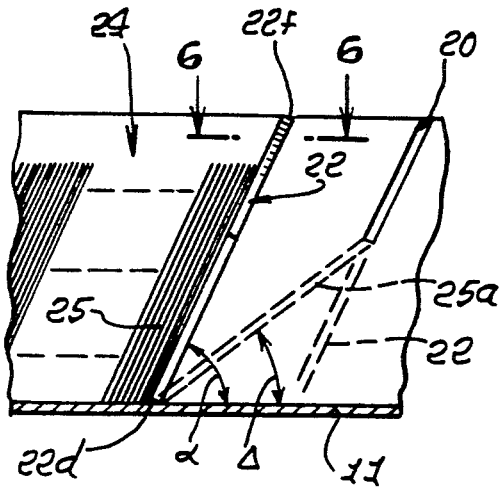
Figure 6:
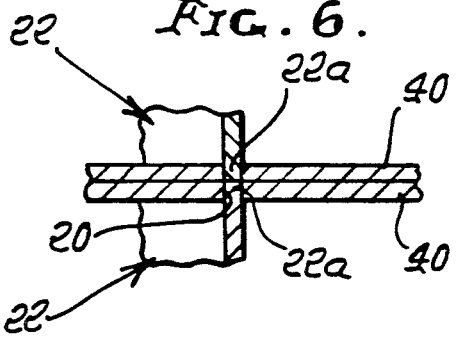
Figure 7:
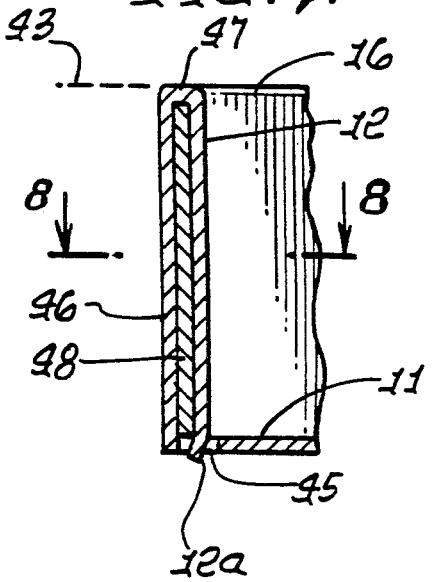
Figure 8:
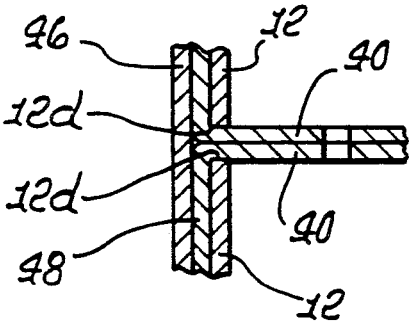

FIG. 4*a* is a view like FIG. 4 showing the divider fully inserted into the slot, and multiple cards supported by that divider;

FIG. 5 is a top plan view taken on lines 5—5 of FIG. 4;

FIG. 5*a* is a section taken on lines 5*a*–5*a* of FIG. 5;

FIG. 6 is an enlarged section taken on lines 6—6 of FIG. 4*a*;

FIG. 7 is a section taken on lines 7—7 of FIG. 1;

FIG. 8 is a section taken on lines 8—8 of FIG. 7; and

Figure 9:
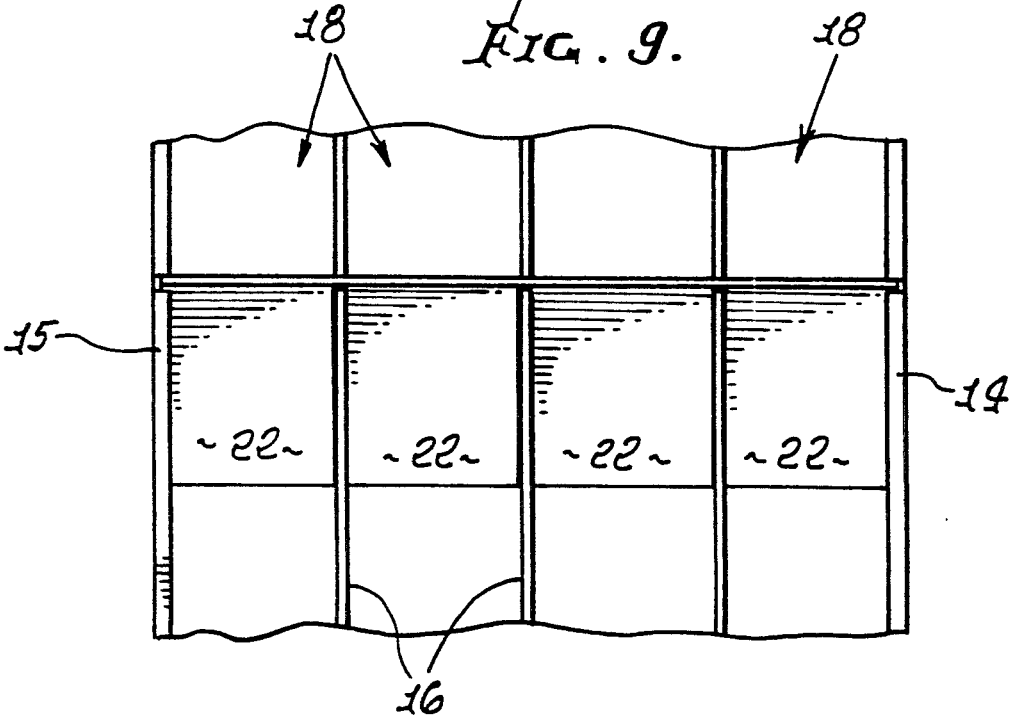

FIG. 9 is a top plan view of a portion of the FIG. 1 box, showing multiple dividers aligned edge-to-edge, in relation to supporting and supported side walls and partition walls.

DETAILED DESCRIPTION

In the drawings, a reinforced box 10 has a bottom wall 11, laterally extending, vertically upright, opposite end walls 12 and 13, longitudinally extending vertically upright side walls 14 and 15, and partition walls 16 that extend vertically and longitudinally between and connected to the opposite end walls as at 17. Accordingly, elongated compartments 18 are formed between the partitions, and between certain partitions and the side walls, these compartments being rectangular in cross sections, formed by lateral upright planes.

Angled slots 20 are cut into the side walls and partition walls to intersect the wall tops 14*a*, 15*a* and 16*a*, which are generally flat, as for example as seen in FIG. 5a. The slots extend at acute angles α relative to a top plane defined by the tops of the side walls and partition walls, as shown. Angle α (see FIG. 4) is between about 75° and 85°, for ease of card front viewing. All of the slots have the same length "1"; and the bottoms of the slots are spaced above the bottom walls 11 by an amount "m", about ⅔ the wall height.

Multiple panel-shaped dividers 22 are carried by and extend between certain selected longitudinally extending walls 14–16, each such divider having wings 22a respectively received in two of the angular slots; and the dividers having lower portions 22b extending below the levels of the wings and slots, and between the longitudinal walls. Accordingly, the dividers and longitudinal walls between which they extend form cells, as at 24 for example, to receive cards 25 (see FIG. 4a) in ordered face-to-face relation, the cards inclined at angle α to frictionally retain their positions in the cells for easy viewing. One example of such cards is baseball cards.

Figure 3:
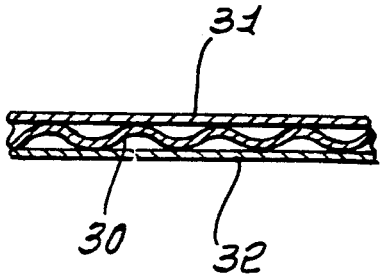
FIG. 3 is an enlarged section taken through a box wall, or through a divider panel.
Figure 2:
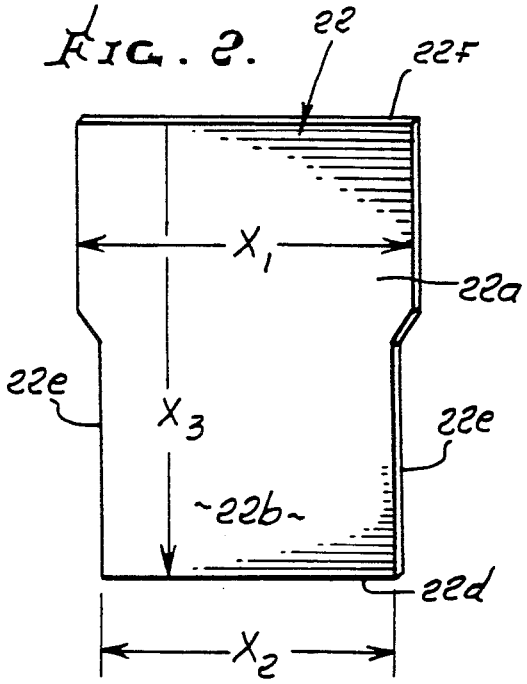
FIG. 2 is an enlarged frontal view of a divider, as used in the FIG. 1 box.

The box walls and dividers typically consist of low-cost cardboard laminate that includes a corrugated layer 30 between and adherent to two outer, parallel sheets 31 and 32, as seen in FIG. 3. Glue is typically used to adhere these elements together; and the entire assembly is extremely lightweight, yet sturdy.

As shown in FIG. 6, the wings 22a of two separate dividers 22 enter a slot 20 from opposite sides thereof, whereby each wing is received in only a portion of the slot, typically about ½ the slot width, each divider thereby being separately supported, easily adjustable, as well as insertible and withdrawable without interference with other wings and dividers.

FIG. 4 shows a divider poised for downward insertion into a slot to bring an angled lower shoulder 22c of the wing into engagement with the lower stop shoulder 20c defined by the bottom of the slot, angled shoulders 22c enabling enhanced in-place adjustability of the inserted divider; and FIG. 4a shows the fully downwardly inserted position of the divider with its lower edge 22d engaging the bottom wall 11 of the box. Wing reception in the slot or slots positions the divider at the angle shown; and the thickness "n" of each slot is typically equal to the thickness of the divider, whereby a light interference fit is provided between the slot walls and the wings enabling ease of insertion and withdrawal of the dividers while positively positioning them, as shown in FIG. 4a. Also, the opposite edges 22e of each divider lower portion are spaced to lightly frictionally engage the sides of the vertical walls between which the divider is received, as for example walls 15 and 16 in FIG. 1. This also acts to positively position the divider in fully inserted position; and when a lateral series of such dividers is provided in the different compartments 18, as seen in FIG. 9, the entire box and its longitudinal walls are strengthened as against wall lateral displacement or bending. In this regard, the bottoms of walls 16 may be attached to or unconnected to the box bottom wall 11, as at 16c. The top 22f of each divider is flush with the plane defined by the tops of the walls 16. A box cover is seen at 80.

Walls 14, 15, and 16 may have double laminate thickness, as seen in FIG. 6, each laminate appearing at 40. In that view, each wing 22a projects into the slot to a depth equal to the thickness of its associated laminate 40, whereby the interfit of the wings and laminates, at the slot 20, is "squared", with minimum interference between adjacent wings, yet maximizing the wing wall laminate interfit and light retention as referred to.

FIG. 5a shows how the wall 16 may be constructed, as by folding a single laminate layer 40 downwardly at the top plane 43, the fold locus indicated generally at 44, bringing the two formed laminates into adjacent, vertical, side-by-side relation. The slot 20 is then cut through both of the laminates 40, as is clear from FIG. 5.

FIGS. 7 and 8 show the end wall laminate 12 folded downwardly from the top plane 43 and between two longitudinally extending walls, as referred to at 16 for example. The end wall laminate 12 has a lowermost tab 12a, which is received in a retention slot 45 formed by the box bottom wall 11. Note also that the end wall is reinforced to have triple thickness with an outer wall portion 46 comprising the same laminate a end wall 12, but folded over at 47, adjacent plane 43; and a intermediate laminate wall section 48 is enclosed between 12 and 46 to provide the triple thickness end wall.

The laminate section 48 in turn is a lateral extension of the laminate 40, which extends longitudinally, as referred to, these folded relationships being seen in FIG. 8. Accordingly, the lateral edges 12d of the end wall laminate 12 frictionally engage the exposed surfaces of the longitudinal laminates 40 to assist in retaining the end wall laminates 12 in folded down position, and in spaced relation to the divider 22, whereby the edges 22e of the divider 20 may accurately engage the exposed surfaces of the laminates 40, such laminates accurately positioned by end wall laminate 12.

Yieldable compressibility of the laminates also enhances close fitness of the dividers and walls, providing a "tight", sturdy, lightweight box assembly.

For best results, to retain baseball cards, the dimensions are as follows:

l = 2½ centimeters, approximately
m = 6.9 centimeters, approximately
n = 4 millimeters, approximately Also, the center-to-center gap "g" or distance between the tops of successive slots 20, is 38 millimeters, approximately, all slots being parallel. The widths of the cells is between 64 and 68 millimeters. The upper width $x_1$ of each divider 22 is about 74 millimeters; its lower width $x_2$ is about 66 millimeters; and its length $x_3$ is about 93 millimeters.

A standard baseball card has a height dimension of 89 millimeters, a width dimension of 63 millimeters, and a thickness of less than 1 millimeter.

These size relationships facilitate ease of storage and retrieval of baseball cards in that when one storage compartment between successive dividers in successive slots is about filled with cards, the rear divider (as in FIG. 4a) may be moved to the next slot 20; and the card 25a closest to the divider, as well as other cards, will lean at an angle Δ which is between about 35°–50° as shown, enabling ease of finger pressure slide-up retrieval of the cards. Otherwise, the cards would recline at such small angles Δ as would hinder their retrieval. The overall baseball card box size is such as to define a 3200 count baseball card box.

I claim:

1. A reinforced box, with adjustable dividers, comprising in combination:

a) the box having a bottom wall, and laterally extending upright, opposite end walls, the box also having longitudinally extending, upright side walls and partition walls extending between and connected to said opposite end walls, b) there being angled slots cut into said side walls and partition walls to intersect the tops thereof, the slot extending at acute angles relative to a top plane defined by the tops of said side walls and partition walls, c) and panel-shaped dividers carried by and extending between certain of said longitudinally extending walls, said each divider having wings respectively received in two of the angled slots, and said dividers having lower portions extending below the levels of said wings and slots, and between said longitudinal walls, d) whereby the dividers and longitudinal walls between which they extend form cells to receive cards in ordered face-to-face relation.

2. The combination of claim 1 wherein said walls consist of cardboard laminate that includes a corrugated layer between and adherent to two outer parallel sheets.

3. The combination of claim 2 wherein the dividers also consist of cardboard laminate that includes a corrugated layer between and adherent to two outer parallel sheets.

4. The combination of claim 1 wherein said slots extend from the tops of said longitudinally extending walls toward the bottoms of said walls, the slots having length substantially less than the vertical height dimensions of said longitudinally extending walls, the divider lower portions having opposite edges below the slots that engage the sides of the longitudinally extending walls to resist lateral deflection of said walls.

5. The combination of claim 3 wherein wings of two separate dividers are received in the same partition wall slot and enter the slot from opposite sides thereof, whereby each wing is received in only a portion of said slot.

6. The combination of claim 3 wherein the tops of said longitudinally extending walls are flat.

7. The combination of claim 2 wherein the walls into which said wings extend consist of doubled thickness laminate acting to engage and position the wings.

8. The combination of claim 5 wherein said partition wall into which said wings of said two separate dividers extend has two cardboard laminate thickness, each laminate including a corrugated layer between and adherent to two outer parallel sheets, whereby each wing extends substantially completely through that portion of the slot defined by one laminate and each wing is carried by one said laminate.

9. The combination of claim 8 wherein said two laminates are defined by a single laminate layer folded downwardly at said top plane to bring said two laminates into adjacent, vertical, side-by-side relation, the slot cut through both said laminates.

10. The combination of claim 1 wherein said wings have lowermost edges that are angled to extend downwardly and sidewardly from within said slots to the exterior of said slots.

11. The combination of claim 1 wherein said walls of the box have multiple face-to-face laminate thickness, that end wall laminate having a section closest to a divider, with said section a) folded downwardly from said top plane and between the longitudinal walls that carry the divider, and b) having a lowermost tab which is received in a retention slot formed by the box bottom wall.

12. The combination of claim 1 wherein gaps are formed between successive slots, said gaps being about 38 millimeters.

13. The combination of claim 1 wherein the slot acute angularity is between 75° and 85°.

14. The combination of claim 11 wherein each slot has a length dimension of about 2.5 centimeters, and each divider has length of about 93 millimeters.

15. The combination of claim 13 wherein each divider has width at said wings of about 74 millimeters.

* * * * *